US007304613B2

(12) United States Patent
Aron et al.

(10) Patent No.: US 7,304,613 B2
(45) Date of Patent: Dec. 4, 2007

(54) BOWTIE MONOPOLE ANTENNA AND COMMUNICATION DEVICE USING SAME

(75) Inventors: Adam R. Aron, Ft. Lauderdale, FL (US); Paul M. Greco, Parkland, FL (US); Jan-Ove U. Mattsson, Plantation, FL (US); Lorenzo Ponce De Leon, Lake Worth, FL (US)

(73) Assignee: Motorola, Inc., Schaumburg, IL (US)

( * ) Notice: Subject to any disclaimer, the term of this patent is extended or adjusted under 35 U.S.C. 154(b) by 51 days.

(21) Appl. No.: 10/872,860

(22) Filed: Jun. 21, 2004

(65) Prior Publication Data

US 2005/0280584 A1 Dec. 22, 2005

(51) Int. Cl.
*H01Q 1/24* (2006.01)

(52) U.S. Cl. ..... 343/702; 343/895

(58) Field of Classification Search ..... 343/702, 343/895; 455/575.7

See application file for complete search history.

(56) References Cited

U.S. PATENT DOCUMENTS 6,204,825 B1 * 3/2001 Wilz ..... 343/841
6,369,775 B1 * 4/2002 Moore et al. ..... 343/893
6,621,464 B1 * 9/2003 Fang et al. ..... 343/795
6,917,334 B2 * 7/2005 Chen ..... 343/700 MS
2005/0233786 A1 * 10/2005 Hatch ..... 455/575.7
2005/0275594 A1 * 12/2005 Zhang et al. ..... 343/702

* cited by examiner

*Primary Examiner*—Hoanganh Le
(74) *Attorney, Agent, or Firm*—Scott M. Garrett

(57) ABSTRACT

A bowtie monopole antenna is fabricated of a sheet metal radiating body 102 that is triangular shaped, and having a longitudinal dimension and axis (106) and a width (108). One corner of the radiating body is tapered to form a feed point (104). The length dimension determines the antenna's lowest resonance frequency while the taper created by the width determines the highest point of resonance. For using the bowtie monopole antenna in a communication device, the radiating body (102) is folded or wrapped around towards itself To facilitate the folding or wrapping a mounting substrate (202) is used. The substrate may be provided with retaining features (206) to capture the antenna assembly within the communication device.

12 Claims, 5 Drawing Sheets

BOWTIE MONOPOLE ANTENNA AND COMMUNICATION DEVICE USING SAME

TECHNICAL FIELD

This invention relates in general to mobile communication devices, and in particular to mobile communication devices having multiple transceivers for accessing multiple radio frequency air interfaces over a single, wideband bowtie type antenna.

BACKGROUND OF THE INVENTION

Mobile communication devices are in widespread use and have become extremely popular and proven useful for business and personal activities. In addition to conventional cellular calling, these devices are being designed to access other types of communication resources, such as wireless local area networks for both data and voice calling, for example. Often these different communication resources are accessed at substantially different frequency bands. Communicating in different frequency bands present a challenge to designers. A designer may chose to use multiple antennas, one for each frequency band, but that approach is impractical and not likely to be received well in the market. A second approach is to design a wideband antenna system using multiple antenna elements. Typically a whip antenna element is paired with a helical antenna element. However, as the size of mobile communication devices continues to decrease, whip antenna elements are not favored, and instead users prefer smaller stub antennas. Therefore there exists a need for a short, stub antenna that provides a broadband response for use with multiple transceivers in a mobile communication device.

DETAILED DESCRIPTION OF A PREFERRED EMBODIMENT

Figure 1:
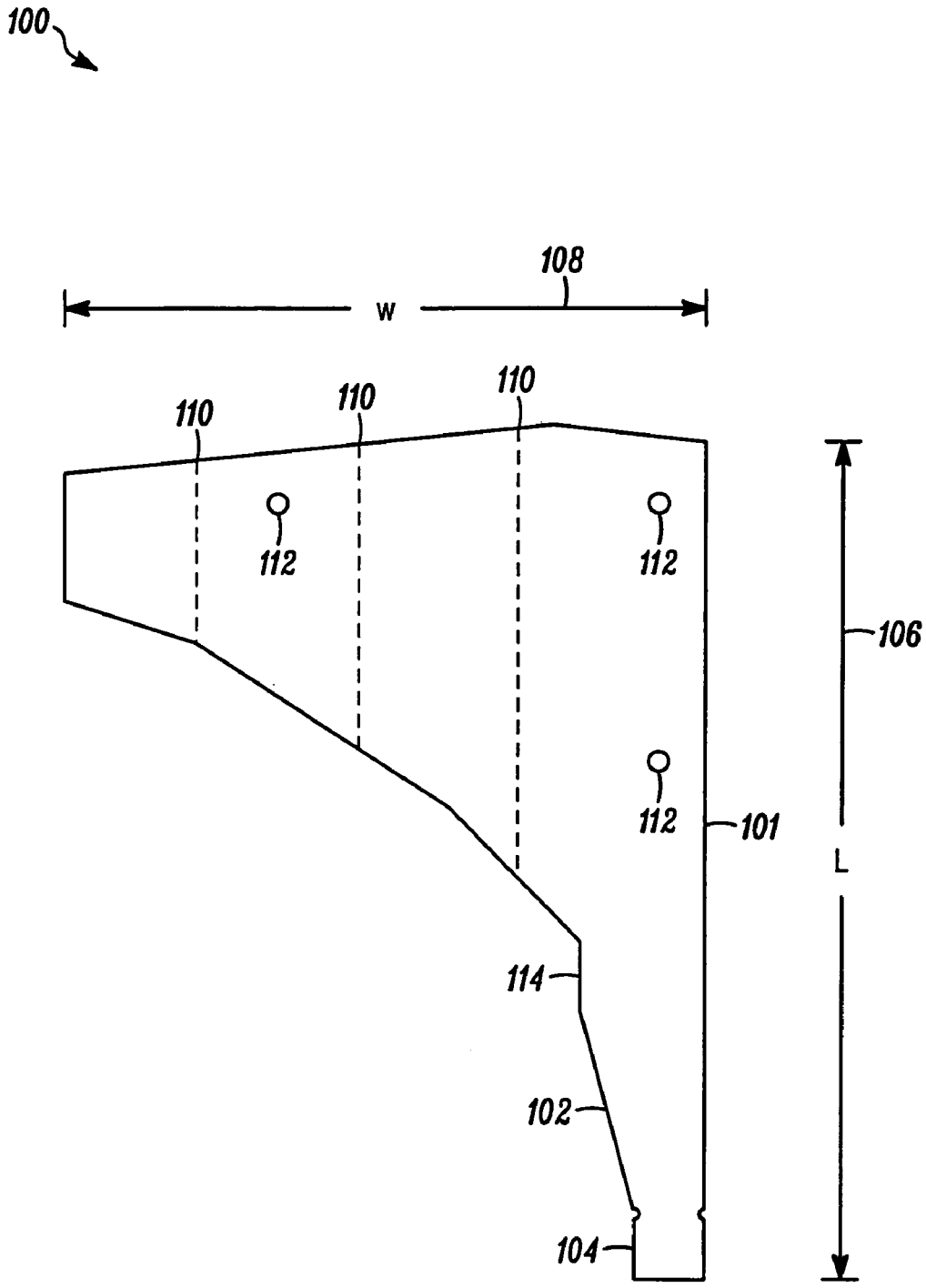
FIG. 1 shows a top plan view of an unfolded bowtie monopole, in accordance with one embodiment of the invention.

While the specification concludes with claims defining the features of the invention that are regarded as novel, it is believed that the invention will be better understood from a consideration of the following description in conjunction with the drawing figures, in which like reference numerals are carried forward.

Referring to FIG. 1, there is shown a top plan view of an unfolded bowtie monopole antenna 100. The antenna comprises a body fabricated from a substantially triangular element of metal sheet, or sheet metal. Bow tie antennas are typically triangular and may be symmetric or asymmetric. The body shown here is asymmetric as the feed point is located near an edge 101 with the body being to the left of the edge. If the antenna were symmetric the location of the edge would be near a centerline of the body with equivalent halves on either side. Typically the body will be stamped or die cut from sheet stock. One corner 102 of the body is tapered to form a feed point 104. The feed point is subsequently stamped or otherwise formed to protrude from the plane of the body so that the tapered corner forms a cantilever that is deflectively sprung. The body has a longitudinal axis 106, and a width 108. In one embodiment of the invention the tapered corner includes a neck portion 114 where both edges are substantially parallel, rather than at an angle.

Figure 2:
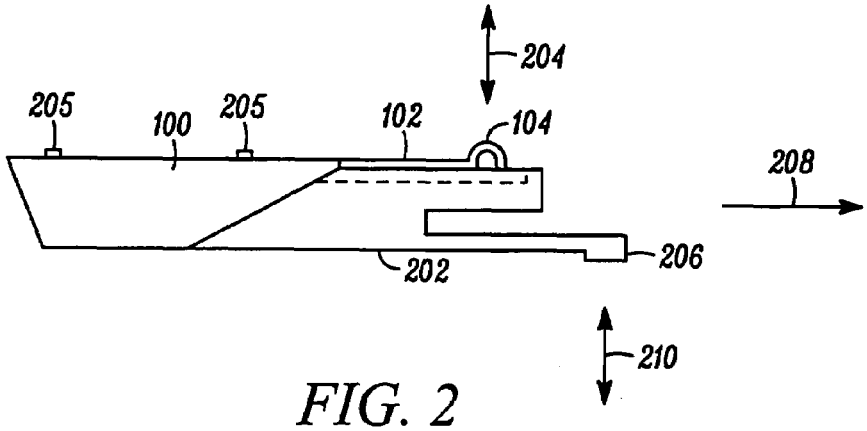
FIG. 2 shows a side view of a bowtie monopole antenna assembly, in accordance with one embodiment of the invention.
Figure 3:
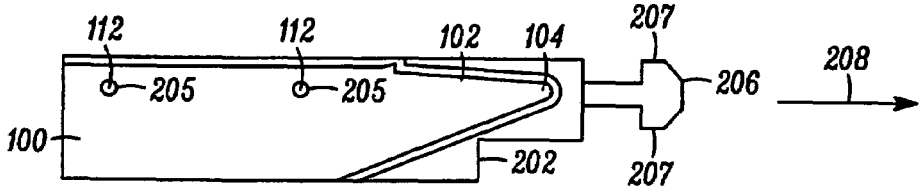
FIG. 3 shows a top view of a bowtie monopole antenna assembly, in accordance with one embodiment of the invention.
Figure 4:
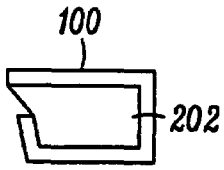
FIGS. 4 and 5 show examples of cross sectional shapes of substrates for use in a bowtie monopole antenna.
Figure 5:
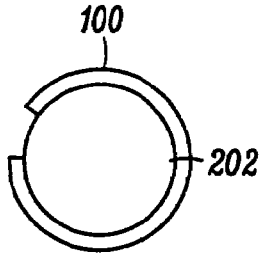

In the preferred embodiment of the invention, the antenna is folded or wrapped around the form of a substrate 202 as shown in FIGS. 2-5. FIG. 2 shows a first side view of the body 100 wrapped onto a substrate 202. The body is folded at edges of the substrate along fold lines 110 shown in FIG. 1. In one embodiment of the invention, the body is folded or wrapped around an axis chat is parallel to the longitudinal axis of die body. To facilitate mounting onto the substrate, the body has one or more small openings 112 that correspond to mounting features 205 on the substrate, and which pass through the openings to hold the body onto the substrate. The substrate provides clearance for the feed point 104 so that the feed point can be deflected in the direction of arrow 204. Once the body is mounted onto the substrate, it is preferred that another layer of non-conductive material be disposed over the body to conceal it. To mount the antenna into the communication device, a cantilevered retaining feature such as an arm 206 is provided on the substrate that extends along an axis of the substrate 208, which is preferably also the axis along which the assembled antenna is inserted into the communication device to couple the antenna to the communication device. The cantilevered retaining arm is deflectable along the direction of arrow 210. FIGS. 4 and 5 show the end view of the antenna assembly; without the exterior non-conductive covering, along axis 208, showing that the substrate can have a variety of cross sectional shapes, including with and without edges. However, it has been found that if the antenna body 102 is wrapped more than once, where there is overlap, the performance of the antenna is degraded.

Figure 6:
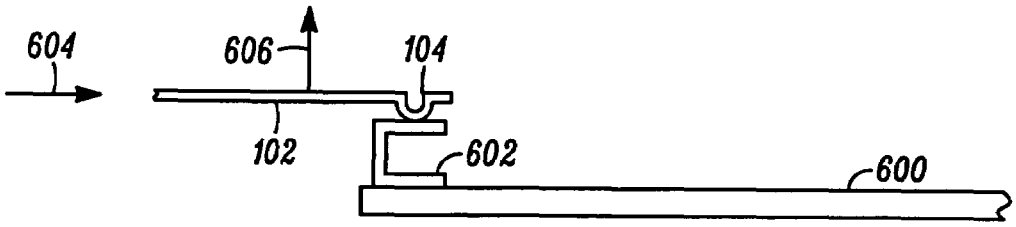
FIG. 6 shows a side view of feed system for feeding a bowtie monopole antenna in a communication device, in accordance with one embodiment of the invention.

FIG. 6 shows a side cross sectional view of the assembled communication device, with all non-essential elements removed for clarity. The communication device includes a circuit board 600 onto which electrical and electronic circuit components are disposed. The circuit board includes a feed pad for coupling to the feed point of the 104 of the body 102 of the antenna. In one embodiment of the invention the feed pad is disposed upon the top of a substantially C-shaped element 602 that is mounted on the circuit board. Preferably by surface mount soldering techniques to a RF feed line or pad on the circuit board. As the antenna assembly is inserted into the housing of the communication device along axis 604, the cantilevered feed point is deflected in direction of arrow 606, which results in a pressure contact being made at the feed point with the feed pad. To prevent oxidation of the feed point 104 it is contemplated the feed point be plated with a layer of non-oxidizing metal, such as gold.

Figure 7:
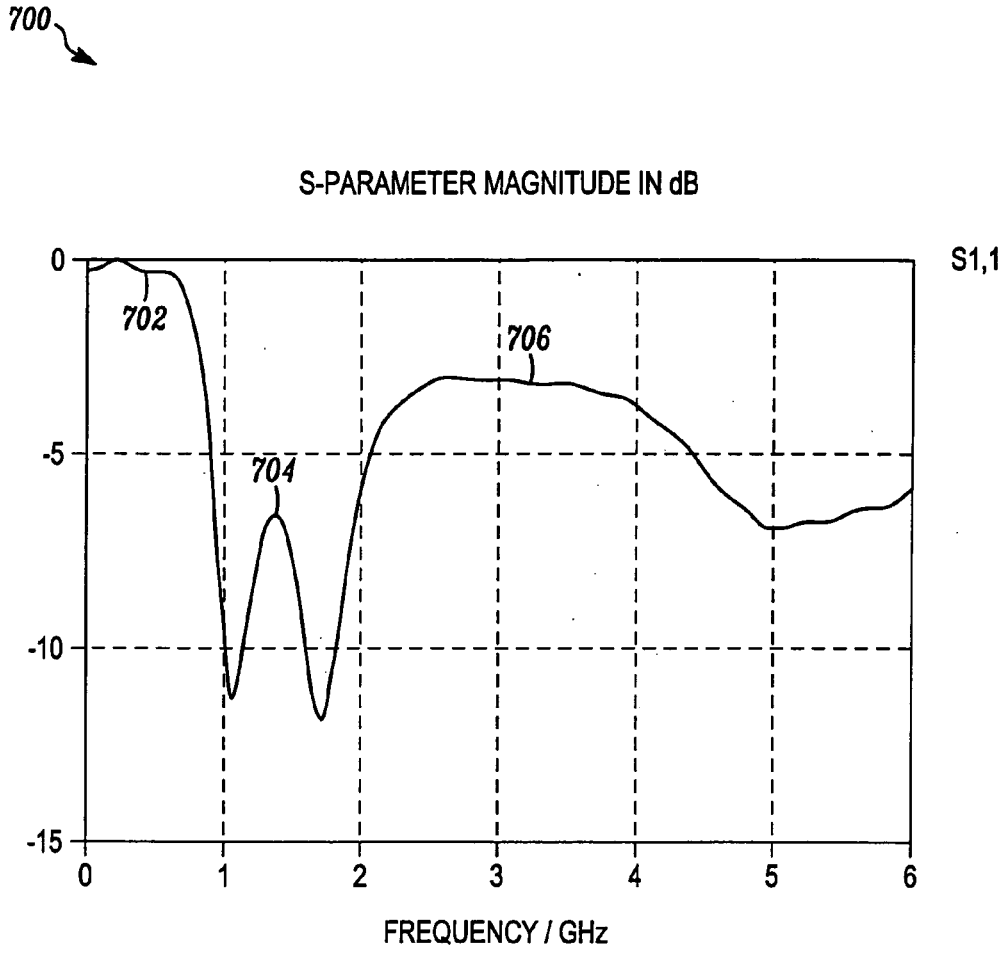
FIG. 7 shows a response chart of the frequency response of a monopole bowtie antenna, in accordance with an embodiment of the invention.

Referring now to FIG. 7, there is shown a response chart of the frequency response of a monopole bowtie antenna, in accordance with one embodiment of the invention. From the response chart it can be seen that the antenna has several resonance point regions 702, 704, and 706, and has a particularly wideband response in the low frequency region 702, and the high frequency region 706. It has been determined that in designing the antenna for response in a desired frequency range, the length 106 of the antenna body determines the lowest resonance while the taper angle, controlled by the width 108 in proportion to the length, determines the highest resonance. It is left as a matter of engineering choice to select the length and width dimensions appropriate for the application under consideration.

Figure 8:
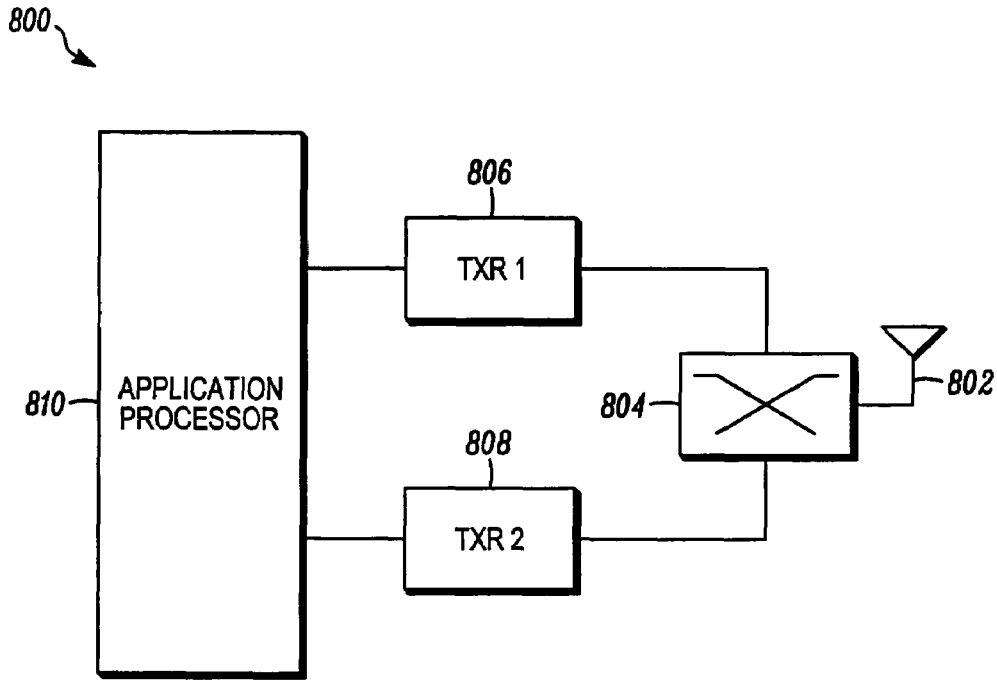
FIG. 8 shows a schematic block diagram of a communication device using a bowtie monopole antenna and having a plurality of transceiver, in accordance with one embodiment of the invention.

Referring now to FIG. 8, there is shown a schematic block diagram 800 of a communication device in accordance with one embodiment of the invention. The communication device includes a bow tie monopole antenna 802 for transmitting and receiving signals over the air. The antenna is coupled to a multi-bandpass filter 804. The multi-bandpass filter may also be referred to as a diplexer, although more than two frequency pass bands may be designed into the filter. The multi-bandpass filter is coupled to a plurality of transceivers 806, 808. The transceivers may operate in different frequency bands. In one embodiment of the invention, a first transceiver 806 operates in a frequency range of 800-1000 MHz, and may be, for example, a digital cellular telephony transceiver. A second transceiver 808 may be, for example, a wireless local area network transceiver, such as that designed in accordance with the Institute of Electrical and Electronic Engineers (IEEE) standard 802.11, operating in a frequency range between 2 and 5 GHz. Each of the transceivers are coupled to a controller or application processor 810 which provide data to, and receive data from the transceivers, as is known.

Figure 9:
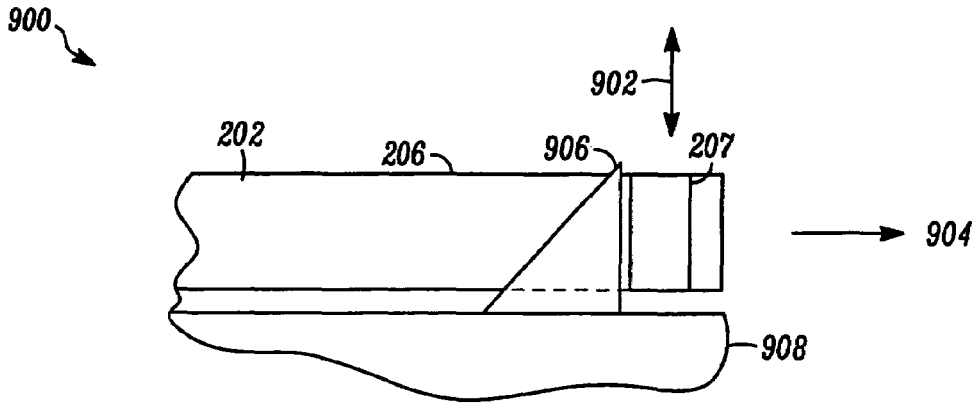
FIG. 9 shows a retaining system for retaining a bowtie monopole antenna, in accordance with one embodiment of the invention.

Referring now to FIG. 9, there is show a retaining system 900 for retaining a bowtie monopole antenna, in accordance with one embodiment of the invention. The cantilevered retaining arm 206 of the substrate 202 is captured as it is inserted into the communication device along the direction of arrow 904. The arm 206 has protrusions 207 extending sideways at the distal end of the arm. As the substrate is moved into position, the protrusions contact a ramp feature 906 formed in a wall or housing of the communication device, and are deflected upwards along arrow 902. Then once moved past the ramp feature, the arm snaps back to a non-deflected position and is retained by interference between the back edge of the ramp feature and the protrusion.

Therefore the inventions provides a bowtie monopole antenna including a body fabricated from a substantially triangular radiating element of metal sheet. The body has a longitudinal axis and a corner portion of the body is tapered to form a feed point. The body may be symmetric or asymmetric in shape, with reference to the feed point. To fit within the design dimensions of a communication device, the body is wrapped or folded. In one embodiment it is contemplated that the body is wrapped around an axis parallel to the longitudinal axis of the triangular radiating element. In one embodiment of the invention the feed point is raised from a plane of the body, and cantilevered to form a spring contact. To facilitate mounting onto the substrates, the body may comprise at least one opening that corresponds with retaining features on the substrate. The substrate, to facilitate assembly into the communication device, it is contemplated, may have a cantilevered retaining feature for retaining the antenna in a communication device. Furthermore, the invention provides for a communication device having a bowtie monopole antenna as described, and further including a plurality of transceivers. The transceivers are coupled to the antenna through a multi-bandpass filter, such as a diplexer. The transceivers may operate in diverse frequency bands, but because of the wide frequency response of the bowtie monopole antenna, each of the transceivers can use the same antenna.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A bowtie monopole antenna, comprising:

a body fabricated from a substantially triangular radiating element of metal sheet, the body having a longitudinal axis; and a corner portion of the body being tapered along the longitudinal axis to form a feed point;

wherein the feed point is raised from a plane of the body, and cantilevered to form a spring contact.

2. A buwtie monopole antenna as defined in claim 1, wherein the body is wrapped around an axis parallel to the longitudinal axis.

3. A bowtie monopolc antenna as defined by claim 1, wherein the body comprises at least one opening to mount the body on a substrate.

4. A bowtie monopoly antenna as defined by claim 3, wherein the body is wrapped around the substrate along an axis parallel to the longitudinal axis of the body.

5. A bowtie monopole antenna as defined by claim 4, wherein the substrate has a cantilevered retaining feature for retaining the antenna in a communication device.

6. A communication device, comprising:

a plurality of transceivers;

a multi-bandpass filter coupled to cach of the plurality of transceivers; and a folded monopole antenna coupled to the multi-bandpass filter for transmitting and receiving signals for the plurality of transceivers, the folded monopole antenna comprising:

a substantially triangular body of fiat conductive material, the body having a longitudinal axis;

a corner portion of the body being tapered to form a cantilevered feed point;

wherein the body is folded around a substratc along an axis parallel to the longitudinal axis.

7. A communication cation device as defined by claim 6, wherein the substrate has a cantilevered mounting feature for mounting the antenna in the communication device.

8. A communication device as defined by claim 6 wherein a first of the plurality of transceivers operates in a frequency range between 800-1000 MHz, and a second of the plurality of transceivers operates between 2-5 GHz.

9. A communication device as defined by claim 6, further comprising:

a circuit board on which circuitry of the communication device is mounted, and having a feed pad in contact with the cantilevered feed point.

10. A communication device as dcfined by claim 9, wherein the feed pad is a top portion of a substantially C-shaped coupling clement that is electrically coupled to the circuit board.

11. An antenna structure, comprising:

a substrate having a longitudinal axis and a cantilevered arm extending in the direction of the longitudinal axis, the cantilevered arm having a retaining feature formed thereon, and a clearance region formcd in a portion of the substrate;

a bowtie monopole antenna body fabricated from a substantially triangular radiating element of metal sheet, a corner portion of the body being tapered along the longitudinal axis to form a feed point, the bowtie monopole antenna body mounted on the substrate round the longitudinal axis;

wherein the feed point is raised from a plane of the body, and eantilevered to form a spring contact which is deflectable into the clearance region of the substrate.

12. An antenna structure as defined in claim 11, wherein the bowtie monopole antenna body has mounting holes formed thercthrough for mounting the bowtie monopole antenna body on corresponding mounting features formed on the substrate.

* * * * *